US006583705B2

(12) United States Patent
Schutten et al.

(10) Patent No.: US 6,583,705 B2
(45) Date of Patent: Jun. 24, 2003

(54) HIGH CURRENT INDUCTOR AND METHOD FOR MAKING SAME

(75) Inventors: Michael Joseph Schutten, Rotterdam, NY (US); Robert Louis Steigerwald, Burnt Hills, NY (US); William George Earls, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/682,487

(22) Filed: Sep. 7, 2001

(65) Prior Publication Data

US 2003/0048168 A1 Mar. 13, 2003

(51) Int. Cl.[7] ..... H01F 27/28
(52) U.S. Cl. ..... 336/229; 336/200; 336/208
(58) Field of Search ..... 336/65, 90, 98, 336/196, 200, 208, 225, 229

(56) References Cited

U.S. PATENT DOCUMENTS 3,008,108 A * 11/1961 Baker et al. ..... 336/229
3,319,207 A * 5/1967 Davis ..... 336/229
4,613,841 A 9/1986 Roberts

* cited by examiner

*Primary Examiner*—Tuyen T. Nguyen
(74) *Attorney, Agent, or Firm*—Ann M. Agosti; Patrick K. Patnode

(57) ABSTRACT

A high current inductor is constructed using two single-sided or double-sided printed circuit boards having patterned copper traces thereon, a magnetic toroidal core, and multiple interconnecting wires extending between the boards. Multiple turns for the inductor are created by suitably configuring the copper traces on the printed circuit boards. Vias are employed on each circuit board for electrically interconnecting the boards to each other. Multiple thick, solid-gauge wires are situated in the vias in order to provide a very large copper area, thus providing high current carrying capability.

9 Claims, 2 Drawing Sheets

HIGH CURRENT INDUCTOR AND METHOD FOR MAKING SAME

BACKGROUND OF INVENTION

High-current inductors are needed in many power converter applications, such as, for example, an output filter inductor for a dc-to-dc converter. Inductors for dc-to-dc converters typically employ a ferrite magnetic core and copper windings, and such inductors typically have a significantly larger dc current component than ac current component. AC flux is limited by the thermal characteristics of the core material and the resistance of the windings. Disadvantageously, the thickness of copper windings is limited by the ability to wind about the core, and the magnetic core must be sized to contain both the ac and dc magnetic flux.

Accordingly, it is desirable to provide an inductor structure that overcomes the structural limitations described hereinabove. Such an inductor desirably has a very high window area fill factor, repeatable electrical characteristics, and well-contained magnetic fringing flux. Furthermore, such an inductor should be simple to construct in order to be practicable.

SUMMARY OF INVENTION

A high-current inductor is constructed using two single-sided or double-sided printed circuit boards having patterned copper traces thereon, a magnetic toroidal core, and multiple interconnecting wires extending between the boards. Multiple turns for the inductor are created by suitably configuring the copper traces on the printed circuit boards. Vias are employed on each circuit board for electrically interconnecting the boards to each other. Multiple thick, solid-gauge wires are situated in the vias in order to provide a very large copper area, thus providing high current carrying capability.

DETAILED DESCRIPTION

Figure 1:
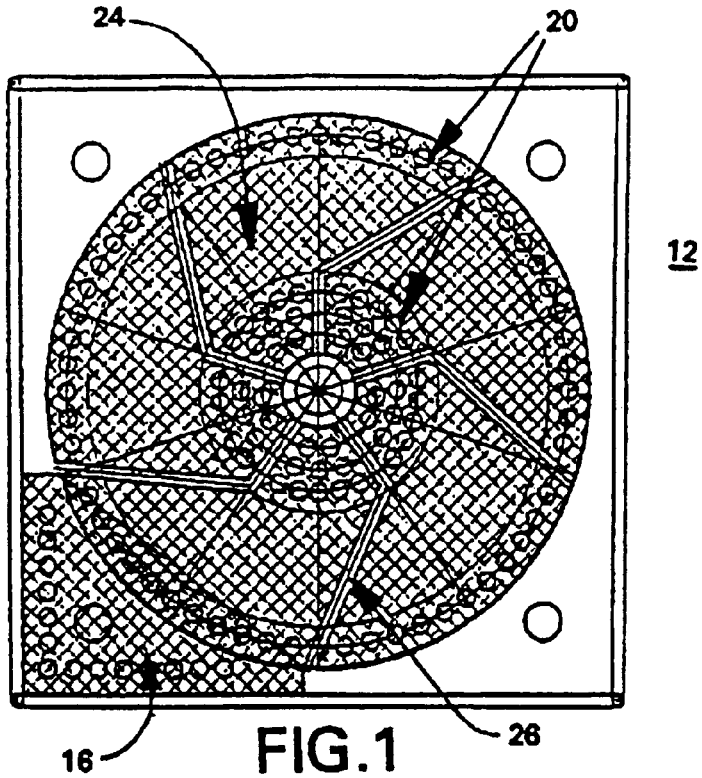
FIG. 1 is a top view illustrating a preferred embodiment of an inductor constructed in accordance with the present invention.
Figure 2:
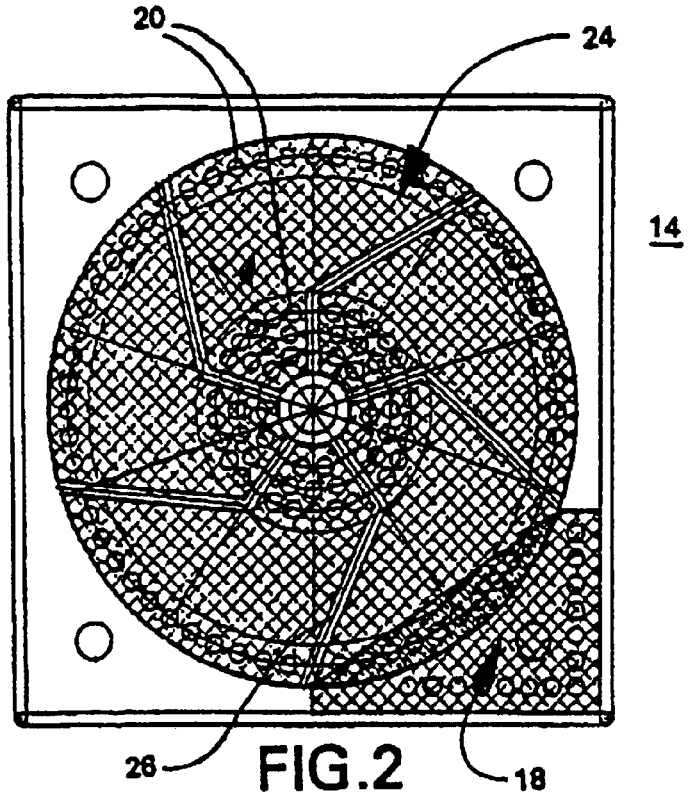
FIG. 2 is a bottom view illustrating a preferred embodiment of an inductor constructed in accordance with the present invention.

FIGS. 1 and 2 illustrate top and bottom views, respectively, of a preferred embodiment of an inductor 10 constructed in accordance with the present invention. Inductor 10 comprises a top printed circuit board 12 and a bottom circuit board 14. Each printed circuit board may comprise a single-sided (i.e., single-layer) or double-sided (i.e., double-layer) printed circuit board, preferably with copper traces. A two-sided printed circuit board would have the same copper pattern on both sides. The copper traces on the printed circuit boards are designed to carry the inductor ac and dc current and are on the order of one-half to ten ounce copper material, for example. Each circuit board 12 and 14, respectively, has an external connector portion 16 and 18, respectively, for providing external electrical connections.

Figure 3:
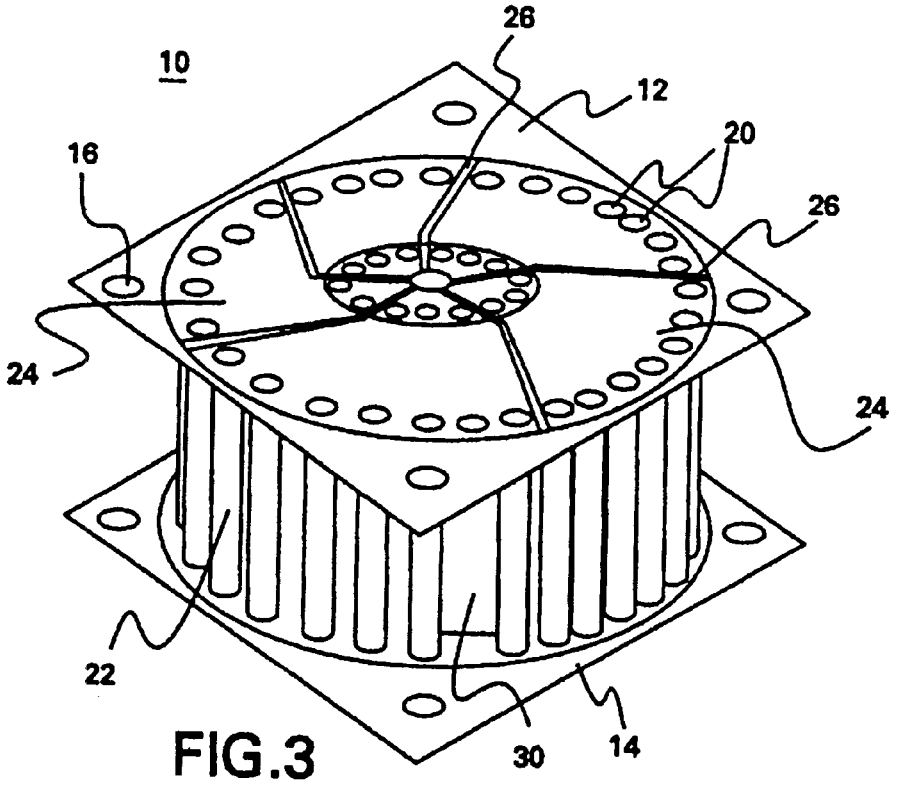
FIG. 3 is an oblique view illustrating a preferred embodiment of an inductor constructed in accordance with the present invention.

Circuit boards 12 and 14 have vias 20 formed therein for providing electrical interconnections therebetween. As illustrated in FIG. 3, relatively thick, elongated, solid-gauge, multi-stranded, or Litz wires 22 are placed in the vias 20 for providing a relatively large copper area for carrying high currents.

The copper on circuit boards 12 and 14 is arranged in either a clockwise or counterclockwise pattern of copper pads 24 separated by regions 26 of removed copper. By way of illustration only, the particular example of FIGS. 1–3 is a five-turn inductor, i.e., having five copper pads 24 and five regions 26 of removed copper. Other turn configurations are possible, as will be appreciated by those skilled in the art.

For the five-turn inductor of FIGS. 1–3, each wedge-shaped copper pad rotates one-tenth of a turn, or 36 degrees. The net result when boards 12 and 14 are interconnected is five turns.

Figure 4:
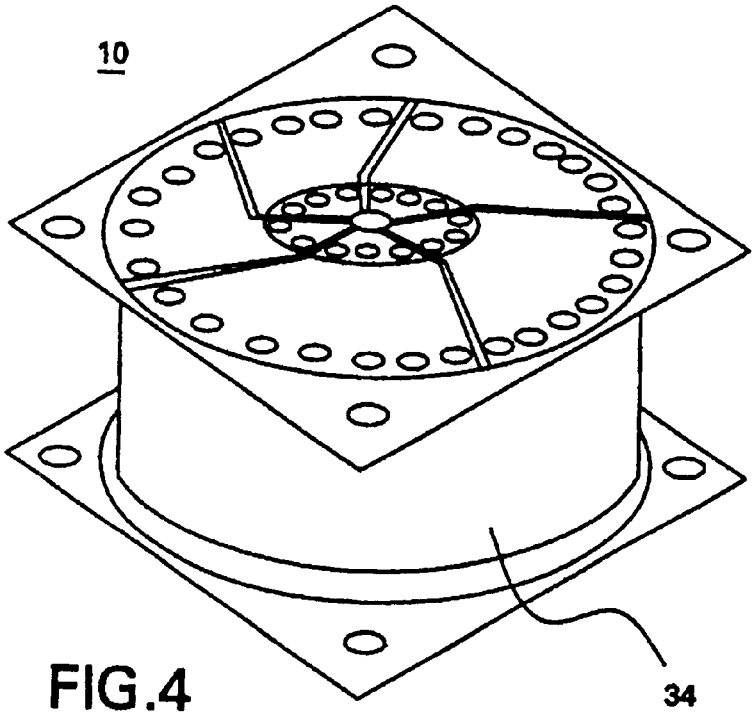
FIG. 4 is an oblique view illustrating an alternative preferred embodiment of an inductor constructed in accordance with the present invention.

As illustrated in FIG. 3, a toroidal core 30 is placed between circuit boards 12 and 14, and wires 22 surround core 30 extend between circuit boards 12 and 14. An exemplary core may comprise a powdered iron core or a ferrite, but other suitable materials may be employed. Wires 22 may be soldered between the circuit boards. FIG. 3 illustrates multiple solid, cylindrical wires 22 extending between circuit boards 12 and 14. An alternative embodiment, as illustrated in FIG. 4, shows the use of a foil wire 34 extending between the circuit boards instead of multiple wires 22. Foil wire 34 could also comprise metal patterned on a dielectric sheet (e.g., Kapton™ polyimide film), if desired. Also, for higher frequency applications, Litz wire or braid wire can be used in place of solid copper wire.

The ac resistance of the inductor of FIG. 3 can be reduced by increasing the number of wires 22. Moreover, the resistance of copper wires 22 is controlled to be very low by employing thick copper traces on the printed circuit boards as well as by using multiple wires 22.

Advantageously, an inductor constructed in accordance with preferred embodiments of the present invention, such as those of FIGS. 3 and 4, for example, is simple to construct and has repeatable electrical characteristics. Moreover, such inductors are advantageously constructed to have very high fill factors, such as in a range from 0.3 to 0.7, for example. For the particular example of FIG. 3, the fill factor is greater than 0.4.

As another advantage, an inductor constructed in accordance with preferred embodiments of the present invention provides well-shielded magnetic flux in the core, as a result of copper surrounding the core.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A high current inductor (10), comprising:

upper and lower printed circuit boards (12 and 14), each of said circuit boards comprising:

a generally planar substrate having an array of vias formed therethrough;

an annular array of generally wedge-shaped conductive metal traces patterned on said substrate, said traces being separated by generally radially extending spaces, said traces having an array of vias formed therethrough corresponding to said vias of said substrate; and an external connector portion (16 and 18) disposed thereon for making external electrical connections;

a toroidal magnetic core (30) situated between the upper and lower circuit boards; and an annular array of wires (22, 34) extending between the circuit boards and surrounding the toroidal magnetic core, wherein opposite ends of said wires are received in said vias in said upper and lower printed circuit boards.

2. The inductor of claim 1 wherein the printed circuit boards comprise metal traces on a single side thereof.

3. The inductor of claim 1 wherein the printed circuit boards comprise metal traces on both sides thereof, the metal traces on each side having substantially the same pattern as the metal traces on the other side.

4. The inductor of claim 1 wherein said wires are selected from a group comprising multiple elongated wires, multi-strand braid wires, and Litz wires.

5. The inductor of claim 1 wherein said wires comprise a metal foil.

6. The inductor of claim 5 wherein the metal foil comprises metal patterned on a dielectric sheet.

7. The inductor of claim 1 wherein the metal traces comprise copper and said wires comprise copper.

8.The high current Inductor of claim 1 wherein the area of said traces is substantially greater than the area of said spaces.

9. The high current inductor of claim 1 wherein said toroidal magnetic core comprises a ferrite.

* * * * *

UNITED STATES PATENT AND TRADEMARK OFFICE

CERTIFICATE OF CORRECTION

PATENT NO. : 6,583,705 B2
DATED : June 24, 2003
INVENTOR(S) : Schutten et al.

It is certified that error appears in the above-identified patent and that said Letters Patent is hereby corrected as shown below:

Column 2,
Line 60, please delete claim 1 and insert
-- 1. A high current inductor, comprising:
upper and lower printed circuit boards, each of said circuit boards comprising:

a generally planar substrate having an array of vias formed therethrough;
an annular array of generally wedge-shaped conductive metal traces patterned on said substrate, said traces being separated by generally radially extending spaces, said traces having an array of vias formed therethrough corresponding vias of said substrate;
and
an external connector portion disposed thereon for making external electrical connections;

a toroidal magnetic core situated between the upper and lower circuit boards; and an annular array of wires extending between the circuit boards and surrounding the toroidal magnetic core, wherein opposite ends of said wires are received in said vias in said upper and lower printed circuit boards. -- therefor.

Signed and Sealed this

Twenty-ninth Day of June, 2004

JON W. DUDAS
*Acting Director of the United States Patent and Trademark Office*